US007872747B2

(12) United States Patent
Gerlach

(10) Patent No.: US 7,872,747 B2
(45) Date of Patent: Jan. 18, 2011

(54) REFLEX SIGHT

(75) Inventor: Karlheinz Gerlach, Biebertal (DE)

(73) Assignee: Schmidt & Bender GmbH & Co. KG, Biebertal (DE)

( * ) Notice: Subject to any disclaimer, the term of this patent is extended or adjusted under 35 U.S.C. 154(b) by 316 days.

(21) Appl. No.: 12/230,532

(22) Filed: Aug. 29, 2008

(65) Prior Publication Data

US 2009/0168057 A1 Jul. 2, 2009

(30) Foreign Application Priority Data

Dec. 31, 2007 (DE) ..... 10 2007 063 407

(51) Int. Cl.
*G02B 23/10* (2006.01)

(52) U.S. Cl. ..... 356/251

(58) Field of Classification Search ..... 356/251–252
See application file for complete search history.

(56) References Cited

U.S. PATENT DOCUMENTS 7,768,703 B2 * 8/2010 Winker et al. ..... 359/432

FOREIGN PATENT DOCUMENTS

| | | |
|---|---|---|
| CN | 538 665 | 6/1973 |
| DE | 26 59 628 | 7/1977 |
| DE | 43 36 956 | 5/1995 |
| DE | 10 2006 035 777 | 2/2008 |
| WO | 97/00419 | 1/1997 |

* cited by examiner

*Primary Examiner*—Michael P Stafira
(74) *Attorney, Agent, or Firm*—Clark & Brody

(57) ABSTRACT

A reflex sight (10) comprises a housing (20) fitted with a proximal aperture (21) and a distal aperture (22) along an optics axis (A). It further includes a projection unit (40) reproducing the light generated by a light source (50) as a target mark (Z), and a feed optics (60) feeding the target mark (Z) reproduced by the projection unit (40) into the beam along the optic axis (A). To preclude the target mark (Z) from being visible to the sighted object, the invention provides that at least one implementing means (61, 62) of the invention be used whereby the target mark (Z) reproduced by the projection unit (40) substantially shall be visible only from the proximal aperture (21). The implementing means (61, 62) of the invention may be a polarizing beam splitting layer (61) designed as an interface layer (65) between two prisms (63, 64). Alternatively a band blocking filter (62) may be used which is configured between the feed optics (60) and the distal aperture (22) and which precludes light reflected by the feed optics (60) from passing through the distal aperture (22) by blocking/filtering such light. To attain economic and simple manufacture of the sight (10), the components (40, 50, 60, 70, 80, 90, 100) of the sight (10) are prefabricated subassemblies that can be installed rapidly and accurately in the housing (20).

36 Claims, 4 Drawing Sheets

REFLEX SIGHT

The present invention relates to a reflex sight with a luminous dot and defined in the preamble of claim 1.

Reflex sights, also called collimator sights, red dot sights or red dot aiming devices are optical sights for firearms and small astronomic telescopes. Contrary to the case of aiming telescopes, they lack magnification, that is, the object looked at through the sight is reproduced at a scale of 1:1.

Moreover reflex sights typically lack a conventional reticle, with crosshairs, instead being usually fitted only with a red, yellow or green luminous targeting dot which is reflected through a semi-transmitting mirror into the marksman's eye. A lens optics (collimator) that this reticle appears at infinity to the marksman. Accordingly the marksman sees through this semi-transmitting mirror the target and, reflected through the mirror the luminous dot. The reticle light beam is incident on the eye exactly from the direction of the line of sight, the reticle always appears at the right place regardless of the eye's relative position (see for instance CH patent 538 665 or DE 43 36 956 B4).

This design allows sighting both accurately and very quickly over short and (small) average distances because the target always can be sensed by both eyes. As a result both 3D viewing and full field of view are retained. Moreover the target spot is reproduced by the optics as being at infinity, whereby the eye is able to simultaneously focus on the target site and the target. Reflex sights therefore are especially useful when applied to a narrow space and in darkness as long as the target per se is still visible.

Such known reflex sights incur a basic problem in that the luminous spot is visible not only to the marksman, but also to the target itself. Depending on the purpose of the planned weapon use, substantial drawbacks may be incurred as a result, in particular when the marksman is prematurely recognized and/or located as a result.

The objective of the present invention therefore is to overcome the above and other drawbacks of the state of the art and to create a reflex sight based on simple, economic implementing means and of which the target mark cannot be perceived by the sighted object or only at very short distances. In order to further extend the range of applicability of the reflex sight, the present invention moreover strives for the goal that the object is prevented from seeing the targeting mark even when a night vision device is employed. Again the sight of the invention shall be lightweight, easy to operate and be manufacturable at low cost.

The main features of the present invention are contained in claim 1. Claims 2 through 36 relate to embodiment modes of the present invention.

Regarding a reflex sight comprising a housing fitted with a look-in aperture, hereafter proximal aperture and a distal aperture, hereafter distal aperture, configured along an optic axis, further a projection unit reproducing the light generated by a light source in the form of a targeting mark, and a feed optics which feeds the targeting mark produced by the projection unit into the beam along the optic axis, the present invention provides at least one implementing means whereby the image mark reproduced by the projection unit substantially is only visible from the proximal aperture.

As a result, the target mark resp. the light source (luminous signature) reproduced by the projection unit now is visible only to the marksman from the proximal aperture, no longer—as heretofore—being also visible from the outside through the distal aperture. The luminous spot and its reflections no longer are visible to the object and thereby the reflex sight's applicability is broadened substantially especially at dusk or at night. Marksman safety is substantially increased.

In this respect a significant design of the present invention provides that one of its implementing means shall be such that the target mark is fed only in one direction relative to the proximal aperture into the light beam along the optic axis. In this manner the light from the light source is precluded from being routed in the direction of the distal aperture. This light source light instead is fed in such manner into the reflex sight's beam that only the marksman sees a virtual target mark (a reticle) through the center of the field of view of the proximal aperture. Said light can not escape in the opposite direction from the reflex sight, and consequently no light signature can be detected from the object being sighted, not even when a night viewing device is being used for detection.

Preferably the implementing means of the invention shall be configured in the region of the feed optics, for instance being part of it, reducing thereby the number of components being assembled. Moreover the feed optics may be a premounted component allowing rapid and convenient integration into the housing. This feature reduces the cost of assembly and hence the cost of manufacture, and is exceedingly useful in mass production.

Preferably said implementing means of the invention is a polarizing beam splitting layer, in particular a MacNeill polarizer. Such a layer may be designed in a manner such that, at an angle of incidence of 45°, it shall effectively separate s and p polarized light over a small range of wavelengths (for instance 50 nm). The light reflected by the correspondingly designed and arrayed feed optics is thereby reflected on itself and returned to the light source. This effect being strongly dependent on the angle of incidence, the observing beam is only slightly affected along the optic axis, that is, viewing through the sight is hardly affected.

In a first embodiment mode of the present invention, the feed optics is a semi-transparent mirror, its polarizing beam splitting layer being deposited as a boundary layer on the mirror.

In another embodiment mode of the present invention, the feed optics is a prism, the polarizing beam splitting layer being an interface on the prism.

In still another embodiment mode of the present invention, the feed optics is in the form of two mutually adjoining prisms, the polarizing beamsplitting layer being configured between the boundary surfaces of the two prisms.

These prisms may be made of materials of difference indices of refraction and they may comprise, at their sides away from the boundary surfaces, mutually parallel planar faces.

In another significant embodiment mode of the present invention, one of the implementing means of this invention is designed in additional or alternative manner so that the light reflected by the feed optics into the distal direction is precluded from exiting the reflex sight. This design again achieves the goal of making the light generated by the light source and the projection unit on the reticle produced by the viewing optics invisible externally through the distal aperture. Accordingly the marksman cannot be detected due to the luminous reticle. Appropriately the implementing means of the invention is configured between the feed optics and the distal aperture.

The implementing means of the invention is a band blocking filter. This filter is designed to block the wavelength range emitted by the light source and reflected by the feed optics into the direction of the distal aperture. As a result the reticle no longer is visible to the object because the light of the luminous target mark cannot pass through the band blocking filter. The light source's wavelength and the design of the band blocking filter are so matched to each other that the view through the sight is only slightly degraded, in particualr that there shall ensue only an insignificant or hardly interfering shift in color perception. It is important however that the light source's wavelengths be filtered out by the band blocking filter, to assure that the sight shall be undetectable by a sighted object or by a night vision device.

In one embodiment mode of the present invention, the band blocking filter is deposited on the feed optics. In an additional advantageous design feature, the band blocking filter is part of said feed optics. In this manner too there is reduction of the number of components to be assembled, with corresponding savings in manufacturing costs, especially when the feed optics is premounted.

In order that the marksman may always sharply see both the target and the target mark, the projection unit does include a collimating optics focusing the reticle at infinity. In this manner the marksman sees the target object through the look-on aperture, the proximal optics and the distal aperture and simultaneously—fed from the feed optics—the luminous reticle, as a sharp dot. The projection unit also shall be in the form of a premounted or pre-fabricated sub-assembly which can be mounted quickly and accurately into the housing.

Compactness is attained by the projection unit comprising at least one fully reflecting mirror. The reticle then can also be projected sideways next to the optic axis and then be deflected appropriately by the mirror.

The present invention furthermore provides that that the light source may be natural light illustratively admitted through a window into the projection unit.

In case natural light conditions were insufficient or undesired, then in addition, the alternative may be an electric light source such as a laser or, in definitely preferred manner, a light emitting diode (LED). Such an LED appropriately is already directly fitted with a stop, so that the number of components is fewer. Preferably the light source is integrated into the projection unit sub-assembly, as a result of which cost of assembly is reduced.

In a significant feature of the present invention, the light source may be dimmed and/or switched. In this manner the light source brightness may be matched to the ambient conditions to avoid glare from the luminous dot respectively the reticle.

Advantageously the separation between the collimating optics and the light source shall be variable.

In order to match or change the point of impact, the target mark position may be varied relative to the optic axis, in particular being horizontally and/or vertically adjustable.

In a first embodiment variation, the feed optics is pivotable relative to the housing, for instance by means of or within a gimbal system.

In addition or alternatively, the projection unit also may be pivotable relative to the optic axis, again within a gimbal system.

To assure both simple and accurate operation of the reflex sight, the target mark can be adjusted without resort to tools, for instance using external adjustment turrets operated rapidly and conveniently by hand. A third adjustment turret may be provided to dim and switch the light source, again without resort to tools. Accordingly the reflex sight is always operated conveniently.

It is important moreover that the target mark shall be free of parallax over a predetermined distance. This goal is attained either by means of an appropriate presetting of the optic components or by the adjustability of the projection unit, light source and/or feed optics, in order that the reticle always shall be optimally situated in the image plane.

Advantageously the reflex sight is made dust proof and water tight for use in extreme ambiences.

Integral housings are advantageous for efficient manufacture. As a result such housings are not only lightweight, but also offer exceedingly high mechanical strength, making the reflex sight suitable for rough use.

Handling the reflex sight is further simplified when the housing can be mounted without tools on a weapon.

Further features, particulars and advantages of the present invention are defined in and result from the appended claims and the description below of illustrative embodiment modes relating to the appended drawings.

Figure 1:
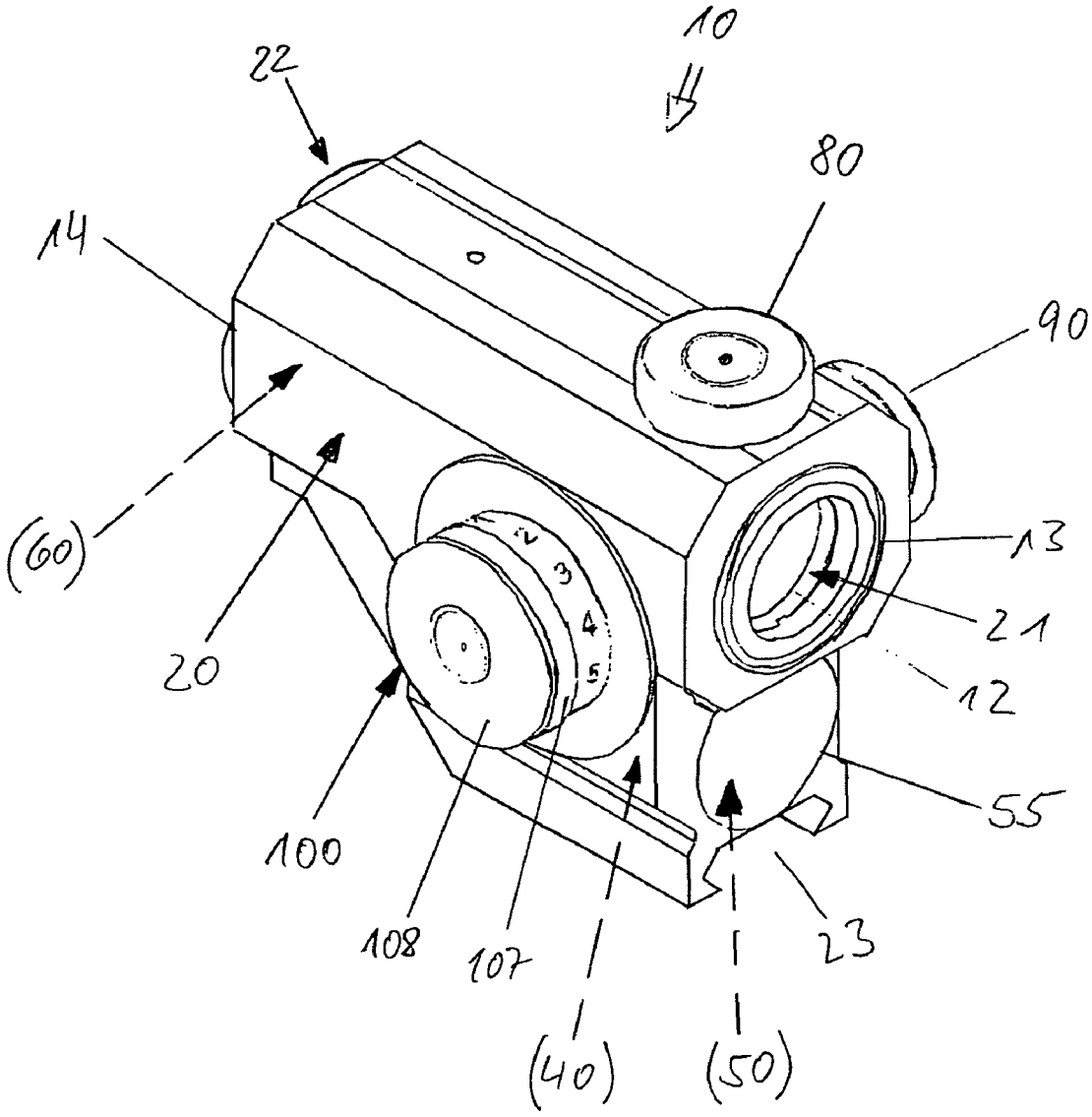
FIG. 1 is an oblique view of a reflex sight of the present invention.

The reflex sight denoted overall by the reference 10 in FIG. 1 comprises a housing 20 receiving a projection unit 40 imaging the light produced by an electric light source 50 in the form of the target mark Z into a feed optics 60. Said feed optics 60 is centrally configured on an optic axis A between a proximal aperture 21 and a distal aperture 22 of the housing 20 and feeds the target mark Z imaged by the projection unit 40 into the beam along the optic axis A. The proximal aperture 21, the distal aperture 22 and the feed optics 60 constitute a non-magnifying optics imaging the target object in a ratio of 1:1 for the marksman. As a result the sight 10 always shall be suitable also for binocular target detection.

FIG. 1 also shows three adjustment turrets 80, 90, 100 configured in the region of the proximal aperture 21 on the housing 20. A height adjustment for the target mark Z is present in a first adjustment turret 80, the second adjustment turret 90 comprising a laterally adjusting element. In this manner the target mark Z projected by the projection unit 40 and fed by the feed optics 60 into the marksman's field of view may be displaced vertically and horizontally relative to the optic axis A and to adjust, respectively change the sight's impact point position.

The third turret 100 controls the brightness of the electric light source 50. For that purpose said turret is fitted with an electronic control 102 (not shown in further detail) driving the light source 50, further with a simple or rechargeable battery 103 applying the appropriate power to the light source 50.

The proximal aperture 21 and the distal aperture 22 s also are centered on the optic axis A. Each is constituted by a flat glass pane 12 secured by threaded annuli 13 and 14 respectively in the housing 20. The annuli 13, 14 are appropriately screwed into recesses/openings 31, 32 in the housing 20. O-rings inserted between the threaded annuli 13, 14 and the housing 20 seal the housing from the outside and accordingly neither dust nor moisture may enter the sight.

A recess 23 constituted at the lower edge of the housing 20 and fitted with undercuts (not shown in further detail) is used to mount the sight 10 on an omitted weapon, for instance a rifle or a handgun. Such mounting may be implemented for instance on an omitted Picatinny rail, a Weaver rail or a 11 mm prism rail.

Figure 2:
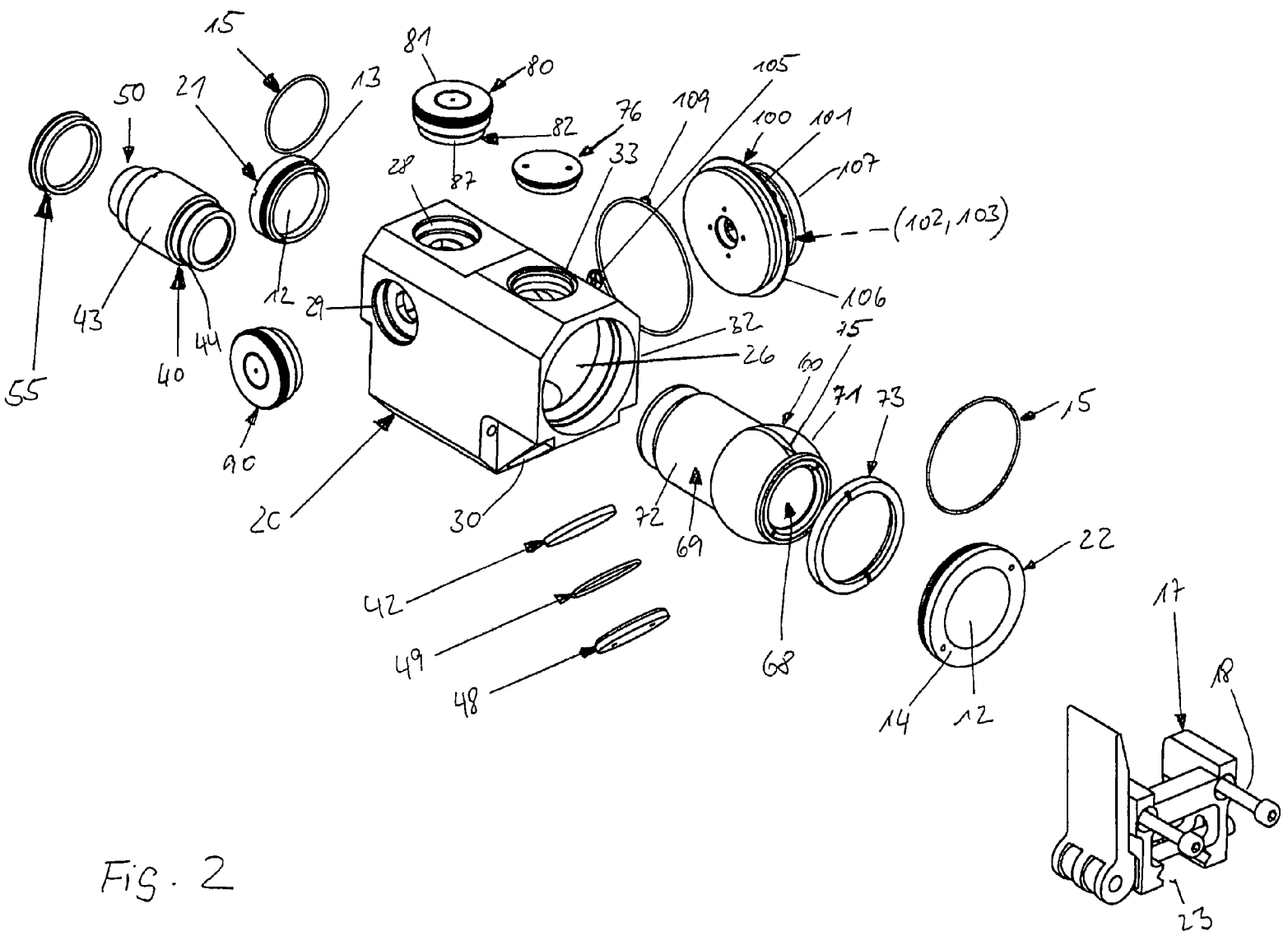
FIG. 2 is an exploded view of the reflex sight of FIG. 1.

FIG. 2 shows that the reflex sight 10 is modular, namely the individual components such as the projection unit 40 and the light source 50, the feed optics 60 as well as the adjustment turrets 80, 90 and 100 each are designed as preassembled sub-assemblies. These sub-assemblies may be prefabricated in accurate and economical manner and then can be quickly and conveniently assembled in to the preferably integral housing 20. For that purpose said housing is fitted with corresponding openings/recesses 24, 26, 28, 29, 30, 31, 32, 33 all of which are fitted at their rims/edges with omitted fine threads.

Figure 3:
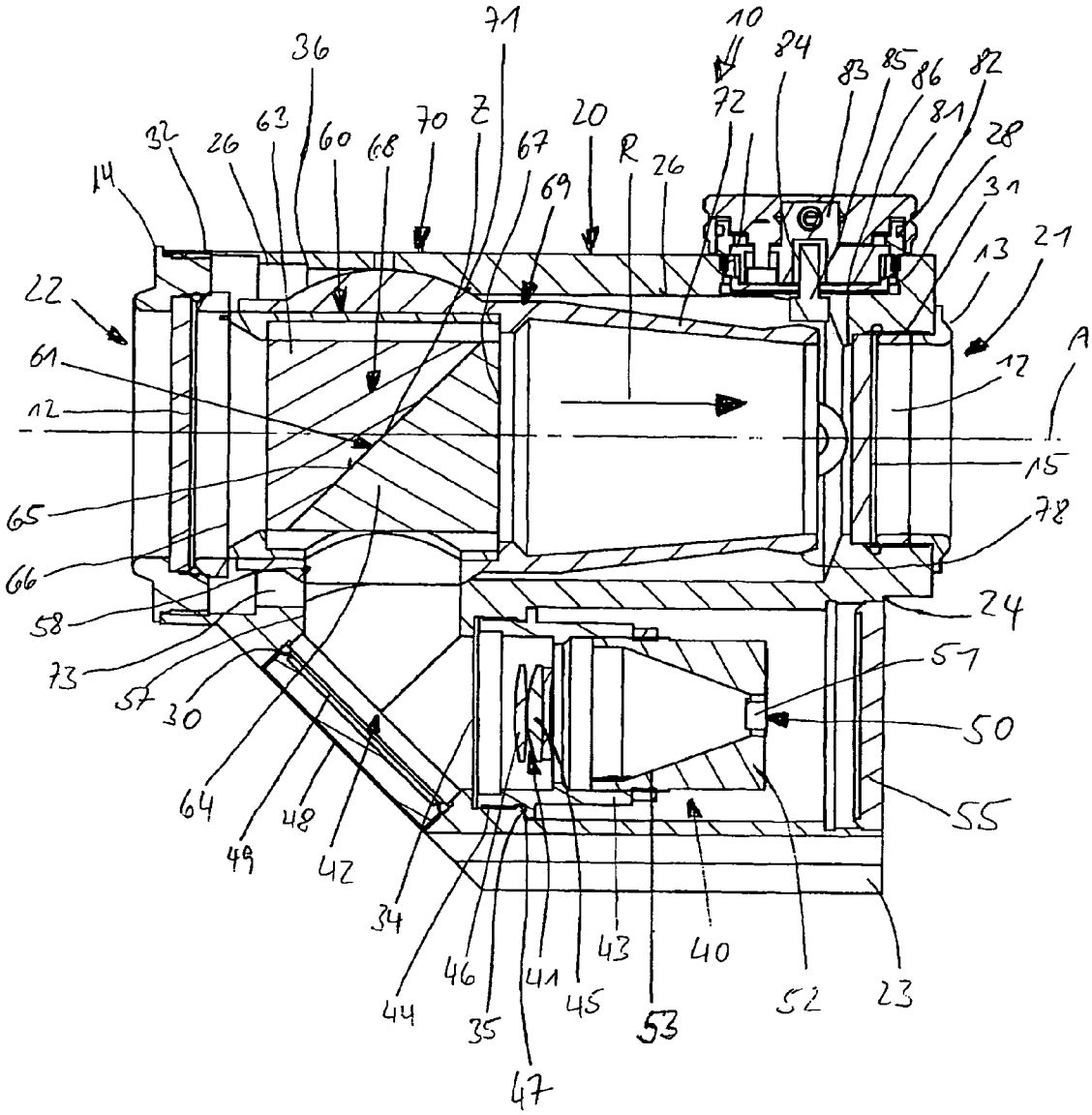
FIG. 3 is a sectional view of the reflex sight of FIG. 1.

Jointly with the light source 50, the projection unit 40 is integrated into a common tube stub 43 fitted at one end with a thread 44 by means of which it is screwed—into the housing 20 (FIG. 3). For that purpose said housing is fitted with an offset 34 comprising a matching inside thread and constituting a step 35 in the direction of the recess 24. In front of its thread 44 the tube stub 43 is fitted with a flange-like collar 47 which shall come to rest against the step 35 when the stub 43 is screwed in. Accordingly said step 35 together with the collar 47 constitutes a stop for the tube stub 43 which thereby can always be accurately installed inside the housing 20.

As shown further by FIG. 2, the projection unit 40 comprises a collimating optics 41 generating the target mark Z and constituted by a cemented lens element unit 45 and a single lens element 46. All three lens elements 45, 46 are rigidly affixed in the stub 43.

The electric light source, 50 is a light emitting diode (LED 51). Said light source is configured centrally in a cylindrical funnel 52 which by means of a fine thread 53 can be screwed into the tube stub 43. In this manner the distance (focal length) between the lens 45, 46 of the collimation optics 41 and the light source 50 is optimally adjustable. The overall symmetry-of-rotation design of the collimation optics 41 and light source 50 inside the tube stub 43 is correspondingly irrotational. An omitted stop is configured in front of the LED 51 in the form either of a thin pane inserted into the funnel 52 or a coating deposited on the body of the LED 51. The omitted electric terminals of the LED 51 preferably are connected by flat cables 105 to the adjustment turret 100 and the integrated circuit 102 and battery 103 therein.

By means of the collimating optics 41 and the LED 51 the projection unit 40 generates a luminous target mark Z in the form of a small, colored spot of light. In order that said spot shall always be sharply visible in the reflex sight, the lens element configuration 45, 46 of the collimation optics is designed in a manner that the stop in front of the LED 51 is always projected at infinity. Accordingly the stop is situated in the focal plane of the lens element array 45, 46, said focal plane always being accurately adjustable in the present invention.

The recess 24 in the housing 20 allowing inserting the sub-assembly 40, 50 into the housing 20 is tightly sealed by a lid 55. An omitted seal such as an O-ring is provided between the lid 55 and the housing 20.

A feed optics 60 is used to feed the target mark Z generated by the projection unit 40 into the beam along the axis A of the reflex sight 10. As shown in detail in FIG. 3, said feed optics is constituted by two prisms 63, 64 abutting each other by their boundary surfaces 65. The boundary surfaces subtend an angle of 45° to the optic axis A, as a result of which light incident from below in the direction of the optic axis A is refracted respectively mirrored. At the same time the target or object to be sighted may be observed freely along the optic axis A through the prisms 63, 64. Accordingly the projection unit 40 is situated centrally on the optic axis A between the proximal aperture 21 and the distal aperture 22 of the housing 20.

The prisms 63, 64 may be made of the same or of different materials with different indices of refraction. The sides 66, 67 of the prisms 63, 64 away from the boundary surfaces 65 constitute parallel planes that may be fitted where desired with further optical components (see below).

Together both prisms 63, 64 constitute a beam splitter 65 integrated into a tube stub 69. In the region of the beam splitter 68, said stub 69 assumes a spherical external contour 71 and in the direction of the proximal aperture it is an overall conical barrel 72. To receive the spherical external contour 71, the housing 20 of the reflex sight 10 is fitted with a matching spherical pan 36, as a result of which the tube stub 69 can be pivoted within the housing 20 in all spatial directions. Accordingly the spherical pan 36 and the spherical external contour 71 constitute a kind of gimbal system.

Installing the feed optics 60 as a subassembly takes place through the openings 26 and 32 in the housing 20 in that the tube stub 69 is inserted by the barrel 72 into the opening 26 until the spherical external contour 71 rests in the unilaterally open spherical pan 36. The conical barrel 72 terminates shortly before the proximal aperture 21, and as a result the inner structures and other geometries in the housing 20 for the marksman are not visible. Next a bearing ring 73 is screwed into the opening 26, both ring and opening being fitted with appropriate threads. The bearing ring 73 complements the spherical pan 36 in the housing 20 and secures the tube stub 69 in the gimbal system, thereby assuring playfree support for the tube stub 69.

The basically parallelipipedic or cubic beam splitter 68 is inserted in such manner into the tube stub 69 that the center of the beam splitter 68 and hence the center of the boundary surfaces 65 is situated at the center of the sphere subtended by the spherical external contour 71. When, by displacing the free end of the barrel 72 upward or to the side, the tube stub 69 is rotated in the spherical pan 36, 73, the angular position of the boundary surfaces 65 do change relative to the optic axis A. Thereby the target mark Z projected onto the beam splitter 68 shall be displaced relative to the optic axis A, and consequently the position of the sight's impact point is adjustable.

Alternatively, to attain a larger range of adjustment for the target mark Z, the center of the beam splitter 68 also may be configured slightly excentrically to the center of the sphere subtended by the spherical external contour 71. Conceivably, as well, the gimbal system 71, 36, 73 may be situated in the zone of the proximal aperture 21 by configuring the spherical external contour at the free end of the barrel 72.

To restrict the adjustability of the target mark Z to two spatial coordinates perpendicular to the optical axis A, a groove 75 is configured (FIG. 2) into the spherical external contour 71 of the tube stub 69 and runs parallel to said axis A. An omitted pin affixed either directly in the housing 20 or in a separate lid 76 engages said groove 75. Said lid is inserted and screwed into the opening 33 in the housing 20. In this instance too, a seal keeps the housing 20 dust free and water tight.

The adjustment turret 80 controls the height of the target mark Z. It is fitted with an adjusting ring 81 which is axially fixed in position but rotatably rests on an annular yoke 82. A threaded segment 83 is configured within the annular yoke 82 and is connected irrotationally to the adjusting ring 81 and in turn comprises a threaded borehole 84. A drive pin 85 is seated in the threaded borehole 84 and is fitted at its end with a corresponding (unreferenced) outside thread and irrotationally slides within a detent ring 86. This detent ring 86 is fitted with an unreferenced outside thread by which it is screwed into the annular yoke 82 and is fitted, at its inside, with omitted detent recesses. Detent elements such as balls configured between the threaded segment 83 and the detent ring 86 engage said detent recesses, so that, when the adjusting ring is rotated, excellent detent positions may be attained. The spaces between the detent recesses and the threaded borehole 84 are matched in a way that the minute-of-angle (MOA)/ click resolution is 1 and that the drive pin 5 is longitudinally displaced at every click by a defined distance.

The installation of the adjustment turret 80 as a prefabricated sub-assembly takes place in the opening 28 in the top side of the housing 20, namely in that the annular yoke 82 is screwed by means of an outside thread 87 into the housing 20. Omitted O-rings seal both the adjustment turret 80 and the housing 20 in dust free and water tight manner.

The drive pin 85 of the adjustment turret 80 rests by its free end against the free end of the barrel 72 of the tube stub 69 of the feed optics 60 and is irrotationally guided within the detent ring 86. When the adjustment lid 81 is rotated, the threaded segment 83 shall turn and, depending on the direction of rotation, the drive pin 85 inserted into the threaded borehole 84 will be retracted into or moved out of the threaded segment 83. The adjustment lid 81 is elected to be of such size that it may be conveniently driven manually even when the marksman should be wearing gloves. In order to further enhance the accuracy of the height adjustment means 80, the rim zone of the barrel 72 is made cross-sectionally convex, its circumferential edge being denoted by 78, whereby the drive pin 85 rests in near point-like manner by its free end against the barrel 72.

The drive pin 85 either may be connected in articulating manner with the barrel 72 or, as shown in the present embodiment mode, it rests against the cross-sectional V-shape of the barrel 72. In this case said barrel is loaded by an omitted spring so that the drive pin 85 drives the barrel 72 against the said spring force. This design offers extremely accurate and playfree support.

The adjustment turret 90 controlling sideways adjustment is identical with the height adjustment turret 80 and is laterally installed as a prefabricated sub-assembly into the opening 29 of the housing. The omitted drive pin of the adjustment turret 90 enters the barrel 72 correspondingly perpendicularly to the drive pin 85 of the adjustment turret 80.

The adjustment turret 100 controlling the brightness of the electric light source 50 comprises a yoke 101 which by means of an outside thread 106 is screwed into an opening in the housing 20. Said turret supports an axially fixed but rotatable adjustment ring 107 allowing adjusting the brightness of the light source 50. The adjustment ring 107 is connected by an omitted mechanism to a adjusting element of the electronic control 102. A lid 108 is inserted into the end of the adjustment turret 100, preferably by screwing, and allows accessing the battery 103 to quickly and conveniently replacing it. The sub-assembly as a whole is sealed against dust and humidity by means of omitted sealing annuli. An O-ring 109 seals the yoke 101 relative to the housing 20 which thereby is also dust and water proof at this site.

Brightness control of the electric light source 50 may be continuous or in steps. In the latter case, the adjustment ring 107 is fitted with system of detent positions allowing quickly perceiving and adjusting each brightness step. The brightness may be divided into steps in the following manner:

Steps 1 through 3: very dark, when using the sight 10 with a night vision means, Steps 4 through 6: fairly dark, when using the sight 10 under poor light conditions, Steps 7 through 11: bright, when using the sight 10 in broad daylight or in the face of bright backgrounds.

To keep the housing 20 compact, the projection unit 40 and the feed optics 60 are mounted superposed on each other in the embodiment mode shown in FIGS. 1 through 3, the feed optics 60 being situated on the optic axis A between the proximal aperture 21 and the distal aperture 22, the projection unit 40 and the collimating optics 41 and the LED 51 being configured parallel underneath.

A fully reflecting mirror 42 is configured at the front housing side to reproduce the image of the target mark Z generated by the projection unit 40 on the feed optics 60, Said mirror is affixed by a lid 48 in the recess 30 of the housing 20. A sealing ring 49 seals the lid from the ambience. FIG. 3 indicates that the mirror 42 subtends an angle of 45° with the optic axis A. A passage 57 is present in the housing 20 in the region of the spherical pan 36 to allow the light from the LED 51 to be freely incident on the beam splitter 68 of the feed optics 60. The tube stub 69 is fitted with a corresponding passage 58.

To preclude the possibility of the sighted object seeing the target mark Z generated by the projection unit 40 and deflected specularly by the feed optics 60 into the beam along the optic axis A or other parts of the light generated by the LED 51, an implementing means of the invention 61 is configured within the feed optics 60 which feeds the target mark Z only in the direction R toward the proximal aperture 21 in the beam along the optic axis A. This implementing means of the invention 61 is a polarizing beam splitter layer 61 configured or formed between the interfaces 65 of the prisms 63, 64.

Illustratively the said polarizing beam splitting layer 61 is a MacNeille polarizer designed in a manner the light reflected by the mirror 42 and incident on the beam splitting layer 61 at an angle of 45° be separated over a small range of wavelengths for instance of about 50 nm into s and p polarized light. The light reflected by the interfaces 65 of the feed optics is thereby reflected into itself and sent back into the light source 51. Accordingly said light can not exit from the sight 10 toward the distal aperture 22. As a result the target mark Z cannot be seen from the outside through the distal aperture 22, not even with a night vision device. The observing beam along the optic axis A is only slightly affected in the process, hence the view through the sight 10 is hardly degraded. Consequently the marksman sees in the usual manner the object and the mirrored target mark.

Configuring the beam splitting layer 61 between the prisms 63, 64 eliminates the need for additional components. Accordingly the implementing means 61 of the invention is part of the feed optics 60 and hence part of the sub-assembly.

A further polarizing filter may be used in another embodiment mode of the present invention to filter a portion of the polarized light already before it is incident on the beam splitting layer 61. Such an additional polarizing filter is appropriately configured between the beam splitter 69 and the mirror 42.

Figure 4:
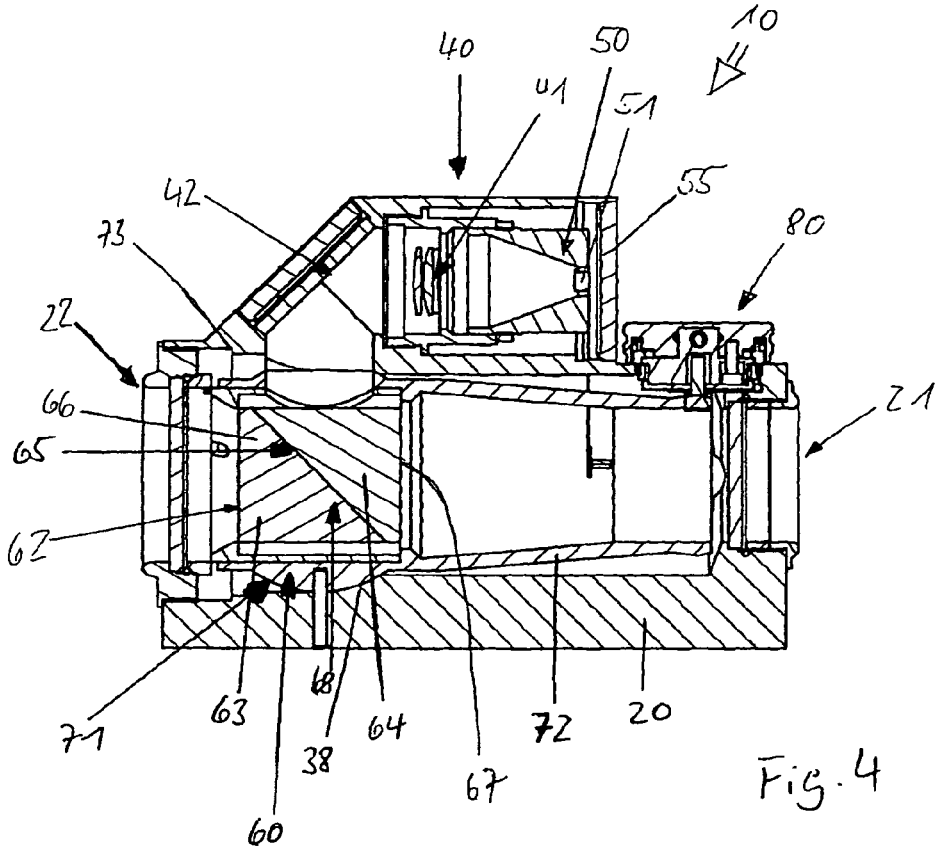
FIG. 4 is a sectional view of another embodiment mode.

An alternative embodiment mode is shown in FIG. 4 and offers the feature that the implementing means 62 of the invention be designed to entirely preclude the light reflected by the feed optics 60 toward the direction of the distal aperture 22 from exiting the reflex sight 10. This implementing means 62 of the invention is a band blocking filter configured between the feed optics 60 and the distal aperture 22. Said filter is designed so that the wavelength range emitted by the light source 50, following reflection by the beam splitter 68, shall be blocked in the direction of the distal aperture 22. As a result the reticle no longer is visible to the object because the light of the luminous target mark cannot pass through the band blocking filter. The light source's wavelength and the design of the band blocking filter are matched to each other in a manner that viewing through the sight shall be only slightly affected, in particular that there result only an insignificant shift in, or one which hardly hampers operation, of color perception. What does matter on the other hand is that those light source's wavelengths be filtered out by the band blocking filter which otherwise would be sensed by a sighted object or detected by a night vision device.

As indicated in FIG. 4, the band blocking device 62 is mounted on the front surface 66 of the beam splitter 68 of the feed optics 60. Said filter thereby is part of the feed optics 60 and hence part of this sub-assembly.

As shown further in FIG. 4, the projection unit 40 is configured above the optic axis A and therefore above the feed optics 60. The optic axis A thereby is shifted closer to the weapon; this feature may be advantageous for some types of weapons or for particular applications.

In another, omitted embodiment of the present invention, the polarizing beam splitting layer 61 and the band blocking layer 52 may be combined, for instance both implementing means of the invention 61, 62 being mounted on or in the beam splitter 68.

Figure 5:
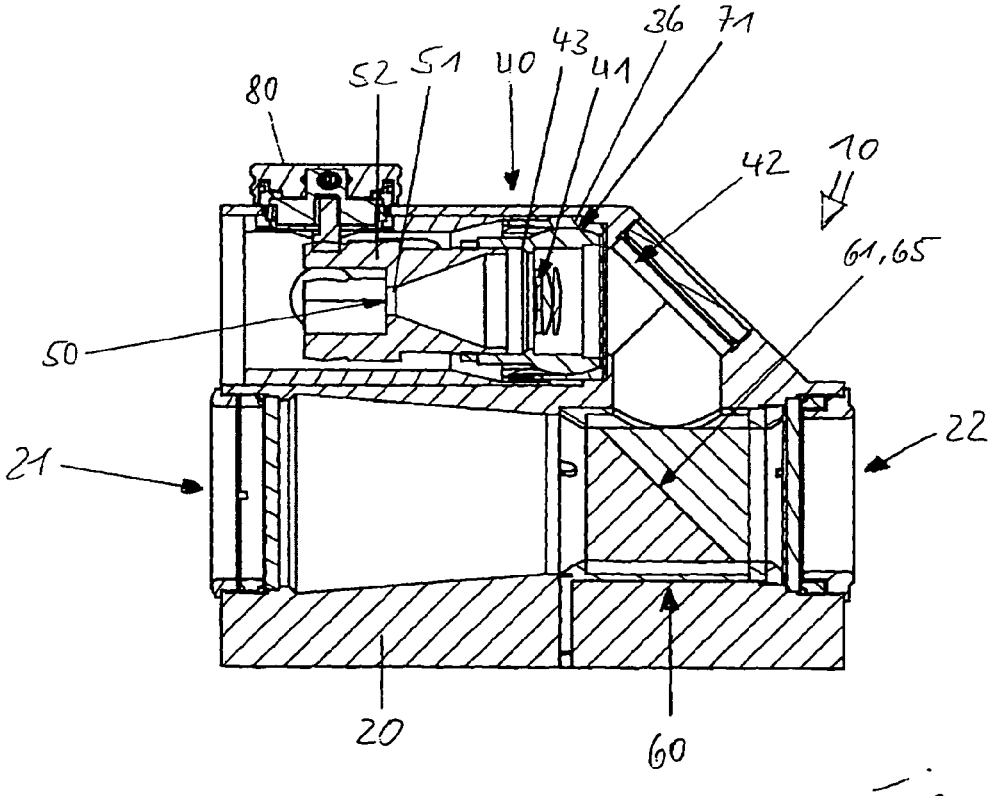
FIG. 5 is a sectional view of a still further embodiment mode of a reflex sight.

The feed optics 60 is rigidly affixed in the housing 20 in the embodiment mode of FIG. 5 whereas the projection unit 40 is pivotable relative to the optic axis A. For that purpose the tube stub 43 is fitted at its end side with a spherical external contour 71 resting in geometrically interlocking manner in a matching spherical pan 36 in the housing 20. The external contour 71 and the spherical pan 36 constitute a gimbal system, and accordingly the projection unit 40 is pivotably supported in at least two spatial directions. The adjustment turrets 80, 90 engage end-side by their drive pins 85 the tube stub 43 respectively the cylindrical funnel 52 of the light source 50.

The light from the light source 50 is collimated by the projection unit 40 and its collimating optics 41 and projected by the mirror 42 onto the beam splitter 68 of the feed optics 60. Said feed optics projects the light as the target mark Z toward the eye of a marksman aiming through the proximal aperture 21. Seen through the optics 21, 68, 22, the target mark Z appears as a sharply defined red dot in the target plane. The polarizing beam splitting layer 61 is configured between the interfaces 65 of the two prisms 63, 64 of the beam splitter 68 in the feed optics 60. Said beam splitting layer assures that the target mark Z is solely visible from the proximal aperture 21.

The design of the sight 10 of FIG. 5 additionally or alternatively also may include a band blocking filter 62.

The brightness of the LED 51 may be adjusted using an adjustment turret 100 not shown in FIGS. 4 and 5 to attain good contrast between the field of view and the reticle under adverse ambient light conditions.

A spectral beam splitting layer may be integrated into the projection unit 40 and/or the feed optics 60 as a complementary feature of the present invention, resulting in red-blue contrast to the marksman's eye.

In summary the reflex sight 10 of the present invention meets the following requirements:

- The sight 10 may be used under very bright, ambient light because the brightness of the light source 50 may be adjusted commensurately,
- The sight 10 may be used while being fitted with a night vision device because the brightness of the light source 50 may be controlled to be appropriately dark
- The sight 10 offers unusually high safety to the marksman because no light source signature may be detected from the object, not even when latter uses a night sight device,
- The sight 10 is suitable for mass production because all components are prefabricated in the form of sub-assemblies, requiring no more than subsequent installation in the housing 20; the particular sub-assemblies meet the highest requirements of accuracy and ruggedness with attending favorable handling and operation of the reflex sight 10

The present invention is not restricted to one of the above discussed embodiment modes, but can be modified in many ways. Illustratively the feed optics 60 may include a semi-transmitting mirror supporting the polarizing beam splitting layer 61 as the interface. The beam splitter 68 of the feed optics 60 however also may be in the form of a simple prism, the polarizing beam splitting layer 61 in this instance also is being deposited as an interface on the prism. Additionally or alternatively, a band blocking filter may also be used in this case.

In still another embodiment mode, the projection unit 40 and the feed optics 60 may constitute one common optics for instance in the form of a double or multiple array of lens elements comprising a partly specular intermediate layer.

In addition to the electric light source 50, natural ambient light may be fed into the housing and to the projection unit 40. In this manner and if the natural ambient light should be ample, energy may be saved, and the battery 103 would need replacing only more rarely.

The assembly recess 23 at the housing 20 also may be designed as a quick connect element 17 affixed by screws 18 into the housing 20. In this manner as well the housing 20 may be mounted quickly and conveniently on a weapon.

Still another (omitted) embodiment mode provides that the projection unit 40 and the feed optics 50 be horizontally adjoining in one plane. In this manner as well the optic axis A is situated relatively close to and above the weapon and the housing 20 as a whole is flat.

Also an additional reticle may be mounted on the beam splitter block 69, for instance in the form of an unlit crosshair or the like, in order to further increase the variability of the reflex sight 10. Or an additional reticle is mirrored into the field of view.

Any protective caps, protective lids, elevation caps or the cap closing the battery case are secured against coming off, that is, they remain connected to the housing 20 following its removal. They are loss proof.

It is understood that a reflex sight 10 comprises a housing 20 fitted with a proximal aperture 21 and a distal aperture 22 along an optic axis A. Said sight moreover includes a projection unit 40 reproducing the light generated by a light source 50 as a target mark Z, and a feed optics 60 feeding the target mark Z reproduced by the projection unit 40 into the beam along the optic axis A. To prevent the target mark Z being detected by the object being aimed at, the invention provides at least one implementing means of the invention 61, 62 allowing the target mark reproduced by the projection unit 40 to be substantially visible only from the proximal aperture 21. The implementing means of the invention 61, 62 may be a polarizing beam splitting layer 61 of which the interface 65 is subtended between two prisms 63, 64. Alternatively a band blocking filter 62 configured between the feed optics 60 and the distal aperture 22 may be used which assures that light reflected from the feed optics be blocked/filtered out in the direction of the distal aperture 22. To attain economic and simple manufacture of the sight 10, its components 40, 50, 60, 70, 80, 90, 100 are prefabricated sub-assemblies allowing being rapidly and accurately installed in the housing 20.

All features and advantages implicit and explicit in the claims, the specification and the drawing, inclusive design details, spatial configurations and process steps, may be construed inventive per se or in arbitrary combinations.

LIST OF REFERENCES

A optic axis
R direction
Z Target mark
10 reflex sight
12 glass pane
13 threaded annulus
14 threaded annulus
17 quick connect device
18 screw
20 housing
21 proximal aperture
22 distal aperture
23 recess
24 recess
26 opening
28 opening
29 opening
30 recess
31 recess
32 opening
33 opening
34 offset
35 step
36 spherical pan
40 projection unit
41 collimation optics
42 mirror
43 tube stub
44 thread
45 cemented lens elements
46 lens element
47 collar
48 lid
49 sealing ring
50 light source
51 light emitting diode LED
52 cylindrical funnel
53 thread
55 lid
feed optics
61 polarizer
62 band blocking filter
63, 64 prism
65 interface/boundary surface
66, 67 plane parallel surface
68 beam splitter
69 tube stub
70 gimbal system
71 spherical outer contour
72 conical barrel
73 support annulus
75 groove
78 rim/edge
80 adjustment turret
81 adjusting cap
82 annular yoke
83 threaded segment
84 threaded borehole
85 drive pin
86 detent ring
87 outside thread
90 adjustment turret
100 adjustment tureet
101 yoke
102 electrical control
103 battery, rechargeable battery
105 flat cable
106 outside thread
107 adjusting ring
108 lid

The invention claimed is:

1. A reflex sight (10) comprising a housing (20) fitted with a proximal aperture (21) and a distal aperture (22) along an optic axis (A), further a projection unit (40) reproducing the light generated by a light source (50) as a target mark (Z) and a feed optics (60) feeding the target mark (Z) reproduced by the projection unit (40) into the beam along the optic axis (A), characterized in that at least one implementing means of the invention (61, 62) is provided which ensures that the target mark (Z) reproduced by the projection unit (40) essentially shall be visible solely from the proximal aperture (21).

2. Reflex sight as claimed in claim 1, characterized in that one of the implementing means of the invention (61) is designed in a manner that the target mark (Z) is fed only in a direction (R) to the proximal aperture (21) into the beam along the optic axis (A).

3. Reflex sight as claimed in claim 1; characterized in that the implementing means of the invention (61) is configured in the region of the feed optics (60).

4. Reflex sight as claimed in claim 1, characterized in that the implementing means of the invention (61) is part of the feed optics (60).

5. Reflex sight as claimed in claim 1, characterized in that the implementing means of the invention is a polarizing beam splitting layer (61).

6. Reflex sight as claimed in claim 5, characterized in that the polarizing beam splitting layer (61) is a MacNeille polarizer.

7. Reflex sight as claimed in claim 1, characterized in that the feed optics (60) is a semi-transmitting mirror, the polarizing beam splitting layer (61) being deposited as a boundary surface on the mirror.

8. Reflex sight as claimed in claim 1, characterized in that the feed optics (60) is in the form of a prism, the polarizing beam splitting layer (61) being deposited as a boundary surface on the prism.

9. Reflex sight as claimed in claim 1, characterized in that the feed optics (60) is constituted by two mutually adjoining prisms (63, 64), the polarizing beam splitting layer (61) being inserted between the boundary surfaces (65) of the two prisms (63, 64).

10. Reflex sight as claimed in claim 9, characterized in that the prisms (63, 64) are made of materials of different indices of refraction.

11. Reflex sight as claimed in claim 9, characterized in that at their sides away from the boundary surfaces (65), the surfaces (66, 67) of the prisms (63, 64) are parallel to each other.

12. Reflex sight as claimed in claim 1, characterized in that one of the implementing means of the invention (62) is designed in a manner that light reflected by the feed optics (60) toward the distal aperture (22) cannot exit the reflex sight (10).

13. Reflex sight as claimed in claim 12, characterized in that the implementing means of the invention (62) is configured between the feed optics (60) and the distal aperture (22).

14. Reflex sight as claimed in claim 12, characterized in that the implementing means of the invention (62) is a band blocking filter.

15. Reflex sight as claimed in claim 12, characterized in that the band blocking filter (62) is designed in a manner that the wavelength range emitted by the light source (50) is blocked.

16. Reflex sight as claimed in claim 12, characterized in that the band blocking filter (62) is deposited on the feed optics (60).

17. Reflex sight as claimed in claim 12, characterized in that the band blocking filter (62) is part of the feed optics (60).

18. Reflex sight as claimed in claim 1, characterized in that the projection unit (40) includes a collimation optics (41).

19. Reflex sight as claimed in claim 1, characterized in that the projection unit (40) includes at least one fully specular mirror (42).

20. Reflex sight as claimed in claim 1, characterized in that the light source (50) is natural light.

21. Reflex sight as claimed in claim 1, characterized in that the light source (50) is an electric light source.

22. Reflex sight as claimed in claim 21, characterized in that the light source (50) is an LED.

23. Reflex sight as claimed in claim 21, characterized in that the LED is fitted with a stop.

24. Reflex sight as claimed in claim 1, characterized in that the light source (50) may be dimmed and/or switched.

25. Reflex sight as claimed in claim 18, characterized in that the spacing between the collimation optics (41) and the light source (50) is variable.

26. Reflex sight as claimed in claim 1, characterized in that the position of the target mark (Z) is adjustable relative to the optic axis (A).

27. Reflex sight as claimed in claim 1, characterized in that the position of the target mark (Z) is adjustable horizontally and/or vertically.

28. Reflex sight as claimed in claim 1, characterized in that the feed optics (60) is pivotable relative to the housing (20).

29. Reflex sight as claimed in claim 28, characterized in that the feed optics (60) is supported in a gimbal system (70).

30. Reflex sight as claimed in claim 1, characterized in that the projection unit (40) is pivotable relative to the optic axis (A).

31. Reflex sight as claimed in claim 30, characterized in that the projection unit (40) is supported in a gimbal system (70).

32. Reflex sight as claimed in claim 1, characterized in that tools are not required to adjust the position of the target mark (Z).

33. Reflex sight as claimed in claim 1, characterized in that the target mark (X) is substantially free of parallax.

34. Reflex sight as claimed in claim 1, characterized in that the housing (20) is dust proof and water tight.

35. Reflex sight as claimed in claim 1, characterized in that the housing (20) is integral.

36. Reflex sight as claimed in claim 1, characterized in that tools are not required to mount the housing (20) on a weapon.

* * * * *

UNITED STATES PATENT AND TRADEMARK OFFICE

CERTIFICATE OF CORRECTION

PATENT NO. : 7,872,747 B2
APPLICATION NO. : 12/230532
DATED : January 18, 2011
INVENTOR(S) : Gerlach It is certified that error appears in the above-identified patent and that said Letters Patent is hereby corrected as shown below:

Title Page Item [56] under References Cited, FOREIGN PATENT DOCUMENTS

"CN 538665 6/1973"
should read:
"CH 538665 6/1973"

Signed and Sealed this
Fourteenth Day of June, 2011

David J. Kappos

David J. Kappos
*Director of the United States Patent and Trademark Office*